United States Patent [19]

Chatham et al.

[11] Patent Number: 4,730,802

[45] Date of Patent: Mar. 15, 1988

[54] DETACHABLE TRAY FOR STEPLADDERS

[76] Inventors: Richard W. Chatham, P.O. Box 6361, Greensboro, N.C. 27405; Charles G. Setliff, Rt. 1, Box 681B, Pelham, N.C. 27311

[21] Appl. No.: 89,435

[22] Filed: Aug. 26, 1987

[51] Int. Cl.[4] ..... E06C 7/14

[52] U.S. Cl. ..... 248/238; 182/129

[58] Field of Search ..... 182/129, 120, 121; 248/238, 211, 210

[56] References Cited

U.S. PATENT DOCUMENTS

| | | | |
|---|---|---|---|
| 768,364 | 8/1904 | Hines | 248/210 |
| 3,052,442 | 9/1962 | Rankin | 248/210 |
| 3,822,847 | 7/1974 | Emmons | 248/210 |
| 3,842,936 | 10/1974 | DeLuca | 182/129 |
| 4,261,435 | 4/1981 | Winter | 182/129 |
| 4,356,854 | 11/1982 | McGee | 182/129 |
| 4,515,242 | 5/1985 | LaChance | 248/238 |
| 4,589,521 | 5/1986 | Finster | 248/238 |
| 4,653,713 | 3/1987 | Hamilton | 248/238 |

FOREIGN PATENT DOCUMENTS

| | | | |
|---|---|---|---|
| 3429033 | 2/1986 | Fed. Rep. of Germany | 248/238 |

*Primary Examiner*—Reinaldo P. Machado

*Attorney, Agent, or Firm*—Charles R. Rhodes; Judith E. Garmon

[57] ABSTRACT

One of the side walls of a tray is provided with a stepladder side rail engaging bracket which includes opposed diverging channel members. Such channel members rest, without any fasteners or the like, upon the exposed upper edges of the side rails or stringers which form one side of the stepladder. The angle formed by the diverging channel members approximates the angle formed by the diverging front and rear side rails of the stepladder when in the open position. The tray may be compartmentalized to carry tools or parts; alternatively it may be partially or totally free of compartments to support paint cans or buckets for other uses.

4 Claims, 3 Drawing Figures

FIG. 2
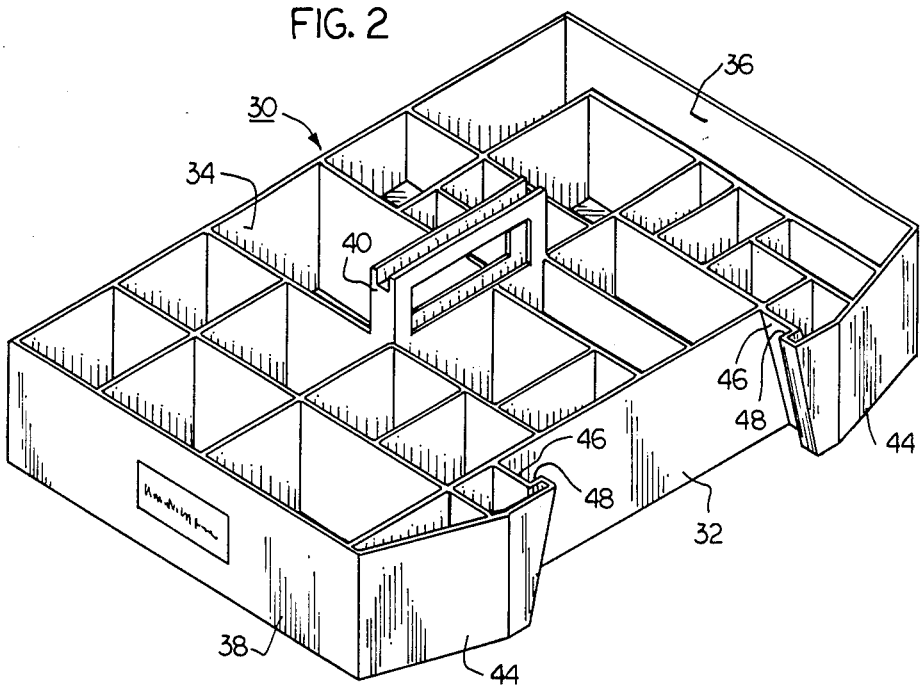
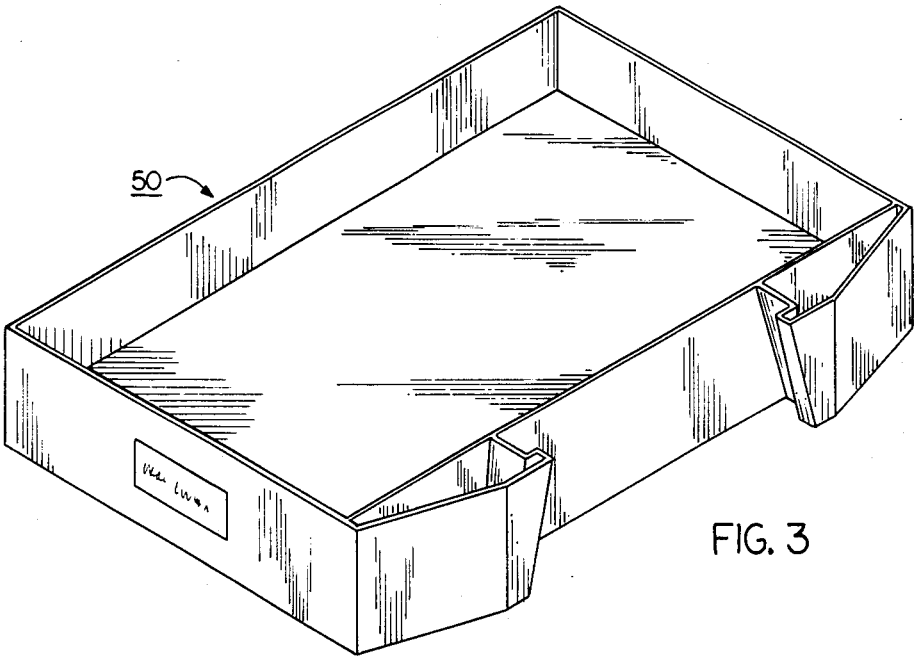
FIG. 3

DETACHABLE TRAY FOR STEPLADDERS

BACKGROUND AND SUMMARY OF THE PRESENT INVENTION

This invention relates to accessories for stepladders, and more particularly to a tray adapted to be quickly attached to and detached from the side rails or stringers of a stepladder without the use of any type of fasteners.

When working upon a stepladder it is often desirable for a workman to have a convenient place to store small parts, tools, equipment, or place paint cans, buckets or the like in the immediate vicinity of the work being carried on. This minimizes the number of times the workman must decend and reascend the ladder. Some stepladders include a foldable shelf hingedly positioned near the top thereof and foldable down to a position extending horizontally from the rear side of the stepladder. This position is not always convenient or at a convenient level, depending upon where the workman is position on the ladder. Generally such foldable shelf extends outwardly away from the person using the ladder so that at most times it is not conveniently accessible. Often the shelf has been completely broken off the stepladder.

A few approaches to the problem have used some type of hanger to suspend buckets or provide a tray that rests on a single side rail of the ladder. Exemplary approaches are illustrated in U.S. Pat. Nos. 768,364; 3,822,847; and 3,052,442.

The present invention, on the other hand is directed to a detachable tray for mounting between the adjacent diverging rails or stringers of one side of a conventional stepladder, so that it may be easily accessible to the workman regardless of his position on the ladder. While the tray of the present invention needs no fasteners, it securely locks into position, is self-leveling, remains level during usage, and is quickly and easily detachable.

As envisioned by the present invention, one of the side walls of the tray includes a stepladder side rail engaging bracket means associated therewith. The aforesaid bracket means forms the heart of the present invention and includes opposed, diverging channel members protruding outwardly from the side wall of the tray which connect to and attach upon the exposed edges of one pair of side rails (front and rear) when the stepladder is placed in the open, operative position. The angle formed between the diverging channels is substantially the same as the angle formed by the diverging front and rear side rails of the erected stepladder. The tray itself may either be flat (in the form of a platform) upon which cans, buckets, tool boxes, and the like may be placed; or alternatively, the tray configuration may be that of a compartmentalized tray which carries a variety of small pieces and components which would be useful for plumbers and electricians. The tray may also include a carrying handle.

Such an arrangement provides a support tray which may be quickly and easily attached to and detached from the adjacent diverging which form one side of a stepladder. When the tray is emplaced it tends to substantially level itself and assumes a secure position that will neither wobble nor tilt.

It is therefore an object of the present invention to provide an improved detachable support tray for use in conjunction with stepladders.

It is another object of the present invention to provide a detachable tray of the type described which is securely emplaced, remains level, and will not swing or wobble during usage thereof.

It is yet another object of the present invention to provide a tray of the type described which is compartmentalized.

Other objects and a fuller understanding of the invention will become apparent upon reading the following detailed description of a preferred embodiment, along with the accompanying drawings in which:

FIG. 2 is a perspective view of the compartmentalized tray of the present invention removed from the stepladder; and FIG. 3 is a perspective view illustrating an alternate embodiment of the invention which appears as a support tray without compartments.

DETAILED DESCRIPTION OF A PREFERRED EMBODIMENT

Figure 1:
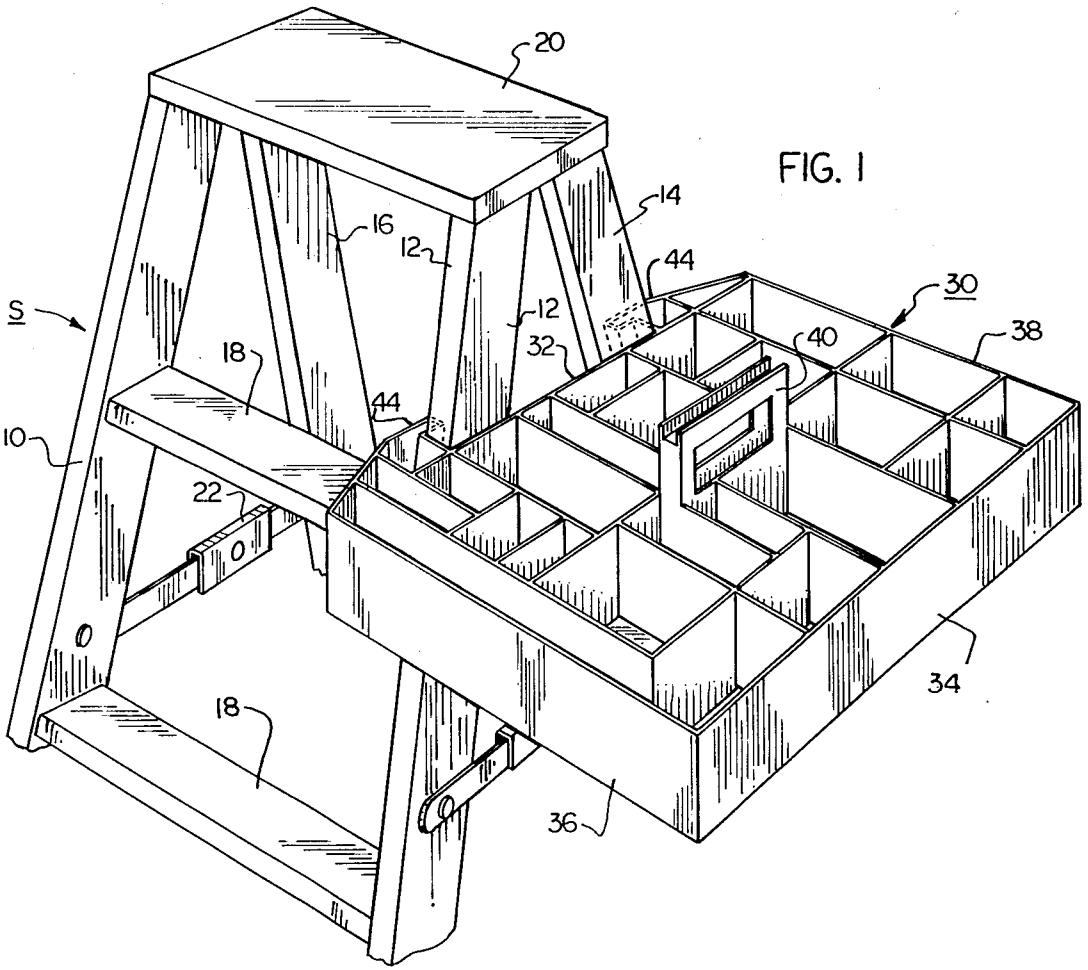
FIG. 1 is a perspective view illustrating the preferred embodiment of the invention in its intended environment as emplaced on a stepladder.

Turning now to the drawings there is illustrated in FIG. 1 a substantially conventional stepladder S of the type employed by construction workers, carpenters, electricians, plumbers, painters, and the like. Conventional stepladders include a plurality of side rails or stringers 10,12,14,16. As illustrated in FIG. 1 in the open position left front stringer 10 and right front stringer 12 form the two front side rails of the ladder, while left rear rail or stringer 16 and right rear rail 14 form the rear rails. The front rails 10,12 of conventional stepladders are joined by steps 18 extending therebetween. A top platform 20 forms the upper end of the stepladder to which the side rails 10,12,14,16 are hingedly attached. A hinged brace 22 normally supports and braces the stepladder in the erect position as illustrated in FIG. 1. It is this type of stepladder with which the present invention is intended for use.

The compartmentalized tray 30 illustrated in FIG. 1 includes side walls 32,34 and opposing end walls 36,38 and a plurality of compartments within the tray. A carrying handle 40 is centrally located to provide a convenient central point for the workman to carry the compartmentalized tray. By way of example, side wall 32 includes the stepladder side rail engaging bracket means 44 of the present invention. While the bracket means 44 could be applied to one of the shorter end walls 36,38, the bending moment might be such that such arrangement would be less sturdy.

Turning now to FIG. 2 the opposed bracket means 44 are better illustrated in connection with the showing of a compartmentalized tray 30. In each bracket means 44 a sloping wall 46 extends outwardly from side wall 32 and is preferably molded integrally therewith. Alternatively, wall 46 could be attached by some type of fastening means which extend through a flange from an inturned flange of wall 46 and into side wall 32. Wall 46 slopes outwardly (hereinafter referred to as "diverging") from top to bottom. Wall 46 terminates in an inwardly turned lip or flange 48 as illustrated in FIG. 2. Each portion of the bracket means 44 may otherwise form additional pockets or pocket sections of the compartmentalized tray.

It should be noted from FIG. 2 that there are two sloping walls 46 spaced along side wall 32 which form diverging channels. Such diverging channels form an angle substantially the same as the angle formed by the divergence of front rail 12 and rear rail 14 when the stepladder S is unfolded to the operative position.

To detach the tray 30 from stepladder S one merely grasps the tray by the end walls 36,38, or by handle 40 and lifts the tray directly upwardly which lifts the diverging channel members 46 from their resting place on rails 12,14. Once the tray is lifted high enough it may be moved horizontally without interference from the side rails 12,14. To emplace the tray 30, the procedure is exactly reversed. Once emplaced, the tray tends to self-level and securely rests on side rails 12,14. There it will not tilt or wobble.

FIG. 3 is illustrative of an alternate embodiment of the tray 30. As illustrated in FIG. 3 tray 50 is not compartmentalized. Tray 50 may either be a flat platform, have shallow side walls or deep side walls depending upon its intended use. Also the handles may be positioned at the ends thereof.

While a preferred embodiment of the invention has been described in detail hereinbelow, it is apparent that various changes and modifications might be made without departing from the scope of the present invention which is set forth in the accompanying claims.

What is claimed is:

1. A detachable tray for mounting on the side rails or stringers of a conventional stepladder in the open position comprising:

(a) a tray member including opposing side walls and opposing end walls;

(b) one of said side or end walls including a stepladder side rail engaging bracket means associated therewith;

(c) said stepladder side rail engagement bracket means including opposed, diverging channel members which rest upon the exposed edges of said side rails when said stepladder is in the open, operative position.

2. The detachable tray according to claim 1 wherein said tray is compartmentalized.

3. The detachable tray according to claim 2 wherein said tray includes a handle member extending upwardly from the central portion thereof.

4. The detachable tray according to claim 1 wherein the angle formed between said diverging channels is substantially the same as the angle formed by the diverging front and rear side rails of said stepladder.

* * * * *